United States Patent [19]

Lahr

[11] 4,218,846

[45] * Aug. 26, 1980

[54] LANE CHANGING TOY CAR WITH UNIDIRECTIONAL CLUTCH AND POSITIVE STEERING

[75] Inventor: Robert G. Lahr, Reseda, Calif.

[73] Assignee: Ideal Toy Corporation, Hollis, N.Y.

[ * ] Notice: The portion of the term of this patent subsequent to Nov. 14, 1995, has been disclaimed.

[21] Appl. No.: 944,042

[22] Filed: Sep. 20, 1978

Related U.S. Application Data

[60] Continuation-in-part of Ser. No. 857,056, Dec. 5, 1977, Pat. No. 4,156,987, and Ser. No. 807,997, Jun. 20, 1977, Pat. No. 4,125,261, which is a continuation-in-part of Ser. No. 783,722, Apr. 1, 1977, Pat. No. 4,078,799, which is a division of Ser. No. 747,441, Dec. 6, 1976, abandoned.

[51] Int. Cl.[3] ..... A63H 30/02; A63F 9/14

[52] U.S. Cl. ..... 46/262; 273/86 B

[58] Field of Search ..... 46/262, 252, 254, 255, 46/259; 192/50, 45.1, 46; 273/86 F, 86 H

[56] References Cited

U.S. PATENT DOCUMENTS

| | | | |
|---|---|---|---|
| 4,125,261 | 11/1978 | Lahr | 46/262 |
| 4,156,987 | 6/1979 | Lahr | 273/86 B |

*Primary Examiner*—Louis G. Mancene
*Assistant Examiner*—Michael J. Foycik, Jr.
*Attorney, Agent, or Firm*—Richard M. Rabkin

[57] ABSTRACT

A toy vehicle is provided for use in a toy vehicle game including an endless track defining at least two parallely extending vehicle lanes in which two or more toy vehicles are operated. The toy vehicles each include a reversible electric rotary drive motor and a transmission operatively engaged between the motor and the drive wheels for driving the vehicles in a forward direction regardless of the direction of rotation of the drive motor. The drive transmission has an idler drive member mounted on a rotatable frame in driving engagement with the output of the motor and is moved into driving engagement with one or the other of the drive wheels depending upon the direction of rotation of the drive motor. The vehicle also includes steering wheels and a second transmission connected between the motor and the steering wheels to rotate the steering wheels between their right and left hand driving positions in response to a reversal of the polarity of current supplied to the motor thereby to bias the car against one or the other of the side walls of the track to guide the vehicles along their path of travel in one or the other of the lanes.

8 Claims, 7 Drawing Figures

LANE CHANGING TOY CAR WITH UNIDIRECTIONAL CLUTCH AND POSITIVE STEERING

This application is a continuation-in-part of U.S. patent applications Ser. Nos. 807,977 now U.S. Pat. No. 4,125,261 and 857,056 now U.S. Pat. No. 4,156,987 filed June 20, 1977 and Dec. 5, 1977, respectively. Application No. 807,997 is a continuation-in-part of U.S. patent application Ser. No. 783,722 now U.S. Pat. No. 4,078,799 filed Apr. 1, 1977 which is a division of U.S. patent application Ser. No. 747,441, now abandoned filed Dec. 6, 1976. The disclosures of all said patent applications are incorporated herein by reference.

The present invention relates to a toy vehicle and, more particularly, to a toy vehicle adapted to be used in a game in which a plurality of toy vehicles are separately controlled by the players to enable them to turn out from one lane to the other and pass other vehicles on the track.

Racing car games of various types are continuously popular with children and even adults, but there has been an increasing demand for more realistic action in such games. Thus, for example, "slot car" type games have been provided with speed control systems which operate by varying current flow to the vehicles in the game. And, a number of such games also provide for crossing the vehicles from one side of the track to another, to simulate an actual changing of lanes. However, the vehicle is constrained in a fixed predetermined and unvariable path, as shown for example in U.S. Pat. No. 3,453,970.

Since the play value of such previously proposed toy vehicle games is limited to the regulation of speed of travel, attempts have been made to provide toy vehicle games which enable an operator to control movement of the vehicles from one lane to the other without the constraint of a guide slot in the track. Such systems include for example the type shown in U.S. Pat. No. 3,797,404, wherein solenoid actuated bumpers are used to physically push the vehicle from one lane to the other by selectively engaging the bumpers along the side walls of the track. It is believed that this type of system will not insure movement of the vehicle from one lane to the other, particularly at slow speeds, and the bumper movements for pushing the vehicle are not realistic.

Other attempts to provide for vehicle control for moving the vehicle from one lane to the other involve relatively complicated steering control mechanisms which respond to the switching on and off of current to the toy vehicle as supplied through contact strips in the track surface. Such systems are disclosed for example in U.S. Pat. Nos. 3,774,340 and 3,837,286. However, in addition to the relative complexity of the steering arrangements, the vehicles will of course lose speed when the current supply is shut off, so that the vehicle will slow down and the realistic effect desired to be produced is affected.

Still other steering systems have been provided in toy vehicles wherein the vehicle's steering is controlled in response to a reversal of the polarity of the current flow to the electrical drive motor in the vehicle. Such systems are disclosed for example in U.S. Pat. Nos. 3,453,970 and 3,813,812, which avoid the problem of stopping current flow completely to the motor so that there is little or no loss of speed, but their steering systems contain numerous moving parts which will wear and require constant attention. In Pat. No. 3,453,970 to Hansen, electrical wires connecting the motor to the current collectors of the vehicle are used to aid in the steering operation and thus may well work loose during use of the vehicle. Another reversing polarity system is shown in U.S. Pat. No. 3,232,005 wherein the toy vehicle does not operate on a track and the steering control is not provided for switching lanes, but rather to provide an apparently random travel control for the vehicle.

Still another toy vehicle game which has been suggested to avoid the constraints of slot car type systems, is disclosed in U.S. Pat. No. 3,238,963 wherein a relatively complex steering control is provided which is responsive to the actuation of a solenoid mounted in the toy vehicle and is controlled remotely by the players.

It is an object of the present invention to overcome the limitations of previously proposed toy vehicle games wherein toy vehicles are permitted to turn out and move from one lane to the other without the restraint of a guide slot or the like.

Still another object of the present invention is to provide a toy vehicle which is adapted to move along a guide track and change from one lane to the other, under the control of a player.

A further object of the present invention is to provide a toy vehicle having a relatively simple steering mechanism that is responsive to a change in the polarity of current flow to the electrical motor in the vehicle, to steer the vehicle into one or the other of the lanes of the track.

A still further object of the present invention is to provide a toy vehicle having a simple drive transmission system which drives the vehicle in a forward direction regardless of the polarity of current supplied to the electrical motor in the vehicle while including a simple steering arrangement that is responsive to current polarity changes.

Another object of the present invention is to provide a toy vehicle of the character described which is relatively simple in construction and durable in operation.

Yet another object of the present invention is to provide a toy vehicle which is relatively simple and economical to manufacture.

In accordance with an aspect of the present invention a toy vehicle is provided for use with one or more toy vehicles in a race game. The toy vehicle includes a frame, a body mounted on the frame, and a plurality of ground engaging wheels, including a pair of drive wheels. The drive wheels are mounted on a common shaft in the frame for simultaneous rotation in laterally spaced vertical planes and a reversible electric motor is also provided for driving the wheels. A drive transmission is mounted in the frame to connect the output of the electrical motor to the drive wheels. The drive transmission includes a spur gear on the output shaft of the motor and an idler support frame rotatably mounted on that shaft. The idler support frame carries an idler gear rotatably mounted thereon in meshing engagement with the spur gear whereby the support frame and idler gear are moved between first and second positions in response to the direction of rotation of the drive motor, thereby to engage one or the other of the drive wheels and drive the wheels in a forward direction regardless of the direction of rotation of the motor.

A second transmission arrangement is operatively connected between the output shaft of the drive motor and the front steering wheels to change the steering wheels from the steering position they occupy to their other steering position when the polarity of current to the motor, and thus its direction of rotation, is reversed.

The toy vehicles of the invention are preferably used on an endless track having laterally spaced side walls defining two laterally spaced vehicle lanes therebetween. When the vehicles are operated the vehicles will move along the track in engagement with and be guided along one of these side walls depending on the steering positions of the front wheels as determined by the polarity of current supplied to their motors; when the polarity of that current is changed the vehicle will switch lanes.

The power supply to the electrical motors of the vehicles is provided through electrical contact strips located in the lanes of the vehicle track. This power supply system is constructed to enable the operators to separately control the speed of the vehicles and also to separately reverse the polarity of current flow to the electrical motors of the vehicles, whereby the vehicles will change lanes.

The above, and other objects, features and advantages of this invention will be apparent in the following detailed description of illustrative embodiments thereof, which are to be read in connection with the accompanying drawings, wherein.

Figure 1:
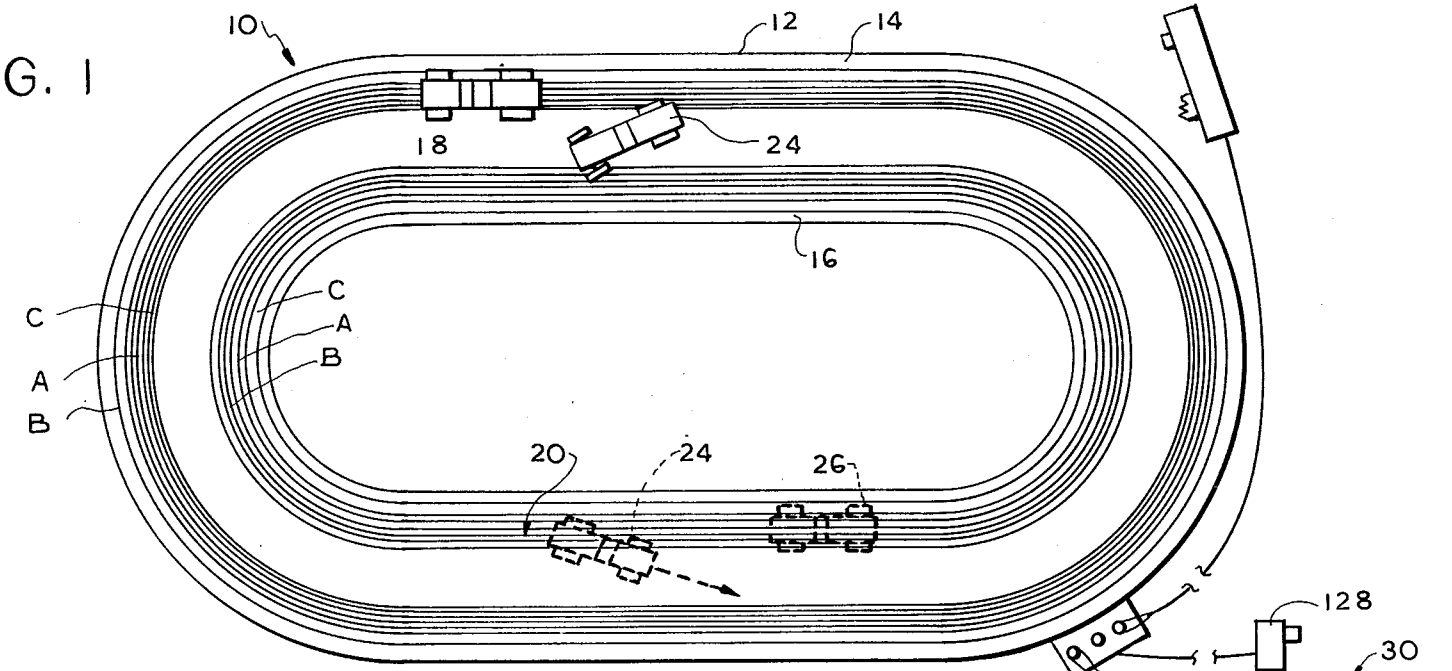
FIG. 1 is a plan view of a toy vehicle game constructed in accordance with the present invention.

Referring now to the drawings in detail, and initially to FIG. 1 thereof, a toy vehicle game 10, constructed in accordance with the present invention, includes an endless plastic track 12 having a pair of laterally spaced upstanding side walls 14, 16 and a road bed or tread surface 18 extending therebetween. The road bed 18 has a width sufficient to define at least two vehicle lanes 20, 22 thereon along which a plurality of vehicles can be operated.

In the illustrative embodiment of the present invention the toy vehicle game includes operator controlled vehicles 24, 26 which are of substantial identical construction except for the arrangement of their current collectors as described hereinafter. Vehicles 24, 26 are separately controlled by the players through a control system 30 which enables the players to vary the magnitude of the current supplied to the rotary electric motors in the vehicles, thereby to vary the vehicles' speed. The controllers also enable the players to change the polarity of current supplied to the respective vehicle motors, whereby the vehicles can be switched by the players from one lane to the other.

Toy vehicle 24 is illustrated in detail in FIGS. 2–6. As seen therein the vehicle includes a frame or chassis 32 of any convenient construction, and a removable plastic body or shell 34 which may be snap fit on frame 32 in any convenient manner. A pair of front steering wheels 36 are rotatably mounted on the frame for simultaneous steering movement between right and left hand steering positions, as described hereinafter, while the rear wheels 40 are mounted on a common shaft 42 which is rotatably mounted in frame 32 (see FIG. 3). Each of the drive wheels 40 is fixed on shaft 42 by a spline or the like or by a press fit or in any other convenient manner for simultaneous rotation with the shaft.

The power for driving the toy vehicle is supplied from a D. C. electric motor 48 mounted on frame 32 in any convenient manner. The electric motor is of conventional D. C. construction and includes a rotary output member or shaft 50 connected to the rotor of the motor in the usual manner. In the embodiment of the invention illustrated in FIG. 2 the shaft 50 extends from opposite ends of the motor housing towards the front and rear wheels. The rear end 51 of the shaft, near the drive shaft 42, has a spur gear or output drive element 52 secured thereto. This output member is drivingly engaged with the transmission system 56 which is constructed to drive the rear drive wheels 40 in the forward direction of travel of the vehicle regardless of the direction of rotation of the output drive element (i.e. the direction of rotation of output shaft 50 of motor 48, due to the polarity of current supplied to the motor).

Each of the drive wheels 40 in the illustrative embodiment of the present invention is formed from either a molded plastic material or from a cast metal material, and has on its inner side an integral crown gear 46 formed thereon by which rotary power is supplied to the respective wheels. In one embodiment the wheels 40 have hubs formed of die cast metal having integrally formed gears 46 thereon and removable annular treads of rubber or the like are fitted over the hubs in the conventional manner.

Figure 5:
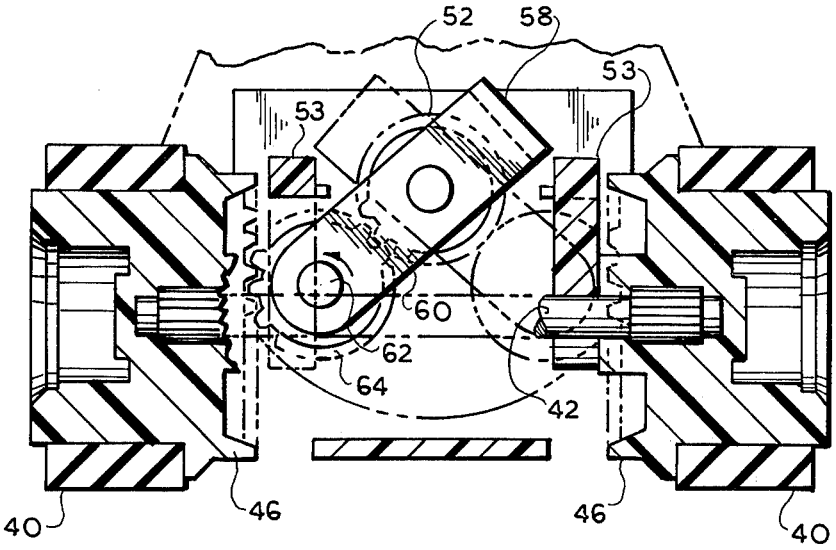
FIG. 5 is a sectional view taken along lines 5—5 of FIG. 2.

Transmission system 56 includes an idler gear support frame 58 freely rotatably mounted on drive shaft 50 with its side plates 60 located on opposite sides of spur gear 52 and extending generally radially from shaft 50. The free ends of plates 60 have a shaft 62 rotatably mounted thereon on which an idler gear 64 is fixed. The idler gear is dimensioned and located to be continuously drivingly engaged with spur gear 52 and selectively engaged with gears 46, as seen in FIG. 5. As a result of this arrangement, when motor 48 is operated the idler support frame will be rotated in either a clockwise or counterclockwise direction, as seen in FIG. 5, depending upon the polarity of the current supplied to motor 48, as a result of the forces applied to the frame due to the engagement of gears 62 and 64. That is gears 52 and 64 will be continuously rotated by the operation of motor 48 and, since frame 60 is freely rotatably mounted on shaft 50, the engagement between gears 52, 64 will produce a resultant force on gear 64 which will rotate frame 60 in the same direction as gear 52. Thus when gear 52 rotates in a clockwise or counterclockwise direction frame 60 will be driven in that same direction. As a result, as seen in FIG. 5, when gear 52 is rotated in a clockwise direction, indicated by the arrow X gear 64 will be rotated in a counterclockwise direction and frame 60 will rotate in a clockwise direction. This rotation of the frame brings gear 64 into driving engagement with the gear 46 on the left rear wheel 40 of the vehicle to drive the drive wheels, as shown in solid lines in FIG. 5. Because gear 64 and frame 60 are located to engage gear 46 forwardly of its axle 42, the drive wheels are driven in a forward direction.

When the polarity of current supplied to the motor 48 is reversed frame 60 will rotate in a counterclockwise direction, to the position shown in dotted lines in FIG. 5. When this occurs gear 64 will be rotated in an opposite direction and moved into engagement with gear 46 on the right drive wheel 40 (i.e. the lower wheel 40 in FIG. 6) so that the drive wheels are again driven in the forward direction.

Figure 3:
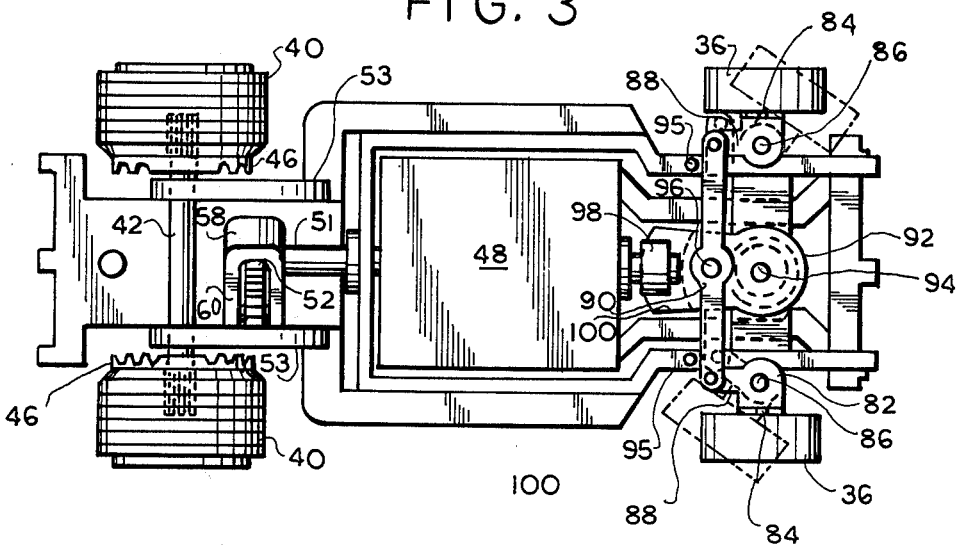
FIG. 3 is a top plan view of one of the toy vehicles illustrated in FIG. 1 showing its steering wheels in one of their steering positions.

As seen most clearly in FIG. 3, vehicle chassis 32 includes integral inverted U-shaped arms 53 having free ends 55 in which wheel shaft 42 is rotatably mounted, as mentioned above. These arms are located inwardly of gears 46, as seen in FIG. 5, and their central bight portions provide clearance for gear 64 to engage gears 46. While engagement of gear 46 with one of the gears 64 will normally stop rotation of frame 60, the upper edge 57 of the bight portions of these arms will provide positive stops or limit positions for frame 60 in its two extreme positions. Alternatively frame 60 may be formed in dimensions such that it will not engage edge 57 but rather would pass along side arms 53 as it rotates. In that case positive stops or shoulders 59 could be provided on the inside faces of arms 53 as shown in dotted lines in FIG. 5.

In order to steer the toy vehicle from one lane to another in response to polarity changes in current supplied to motor 48 a second transmission 80 is provided between the second end of shaft 50 near front steering wheels 36. This transmission operatively connects shaft 50 with wheels 36 to move the wheels between their left and right hand steering positions in FIGS. 3 and 4.

Steering wheels 36 each include wheel mounting brackets 82 that include horizontal axles 84 on which the wheels are rotatably mounted in any convenient manner and vertical pivot pins 86 pivotally mounted in frame 32 to permit the wheels to pivot in vertical planes to effect steering. Brackets 82 include integral crank arms 88 which are pivotally connected by a tie rod 90 which controls simultaneous pivotal steering movement of brackets 82 and thus wheels 36. Movement of tie rod 90 is in turn controlled by transmission 80 which includes a pivot or steering arm 92 pivotally mounted on a post 94 in frame 32 for horizontal swinging movement between first and second positions. These positions may be defined or limited by stop posts or abutments 95 or the like formed in frame 32.

Steering arm 92 is loosely pivotally connected to tie rod 90 by an integral pin 96 or the like so that arcuate movement of arm 92 is transmitted through the tie rod to cranks 88 and wheels 36. Thus arcuate movement of arm 92 causes steering of wheels 36 with the extreme limit positions of arm 92 corresponding to the left and right hand steering positions of the wheels 36, as seen in FIGS. 3 and 4.

Movement of arm 92 is responsive to the rotation of shaft 50 on which a rotary drive element 98 is mounted. In the illustrative embodiment of the invention this drive element is simply a friction wheel which frictionally engages the upper surface 100 of arm 92. That surface is arcuately shaped, in plan. Preferably surface 100 is biased into frictional driven engagement with wheel 98 by a spring 102 surrounding the pivot post of the arm.

By this arrangement, when the drive element 98 is driven in the direction indicated by the arrow X in FIG. 3 it drives arm 92 to one of its extreme positions thus positioning the steering wheels in one of their steering positions. Since movement of the arm 92 is blocked beyond this limited position the wheel 98 will simply slip on surface 100. Thus, in effect, wheel 98 and surface 100 act as a slip clutch or intermittent drive transmission.

Figure 4:
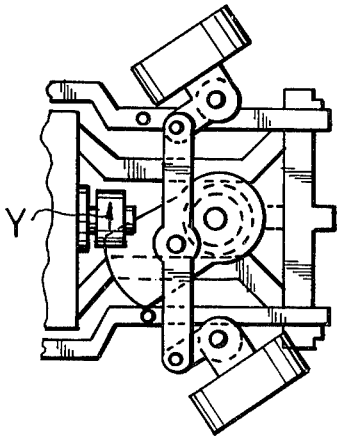
FIG. 4 is a fragmentary top plan view, similar to FIG. 3, showing the steering wheels in their other steering position.

When the current supplied to motor 48 is reversed, friction wheel 98 will be driven in the opposite direction, as indicated by the arrow Y in FIG. 4. At the point of current, reversal arm 92 is free to move to its other position and is thus driven by the friction wheel until its limit position in FIG. 4 is reached, and wheel 98 begins to slip on surface 100. In this manner the steering wheels are turned to their other steering position causing the vehicle to switch lanes. The wheels stay in their steering positions as the vehicle moves in its lane and thus aid in holding the car against the guide rails of the track. This serves to keep the hereinafter described current collectors aligned with the current supply strips in the track.

It is noted that while the illustrative embodiment of the invention uses a slip drive and stops to limit movement of arm 92, other equivalent arrangements can be used. For example surface 100 could be formed as a sector gear and drive element 98 could be a spur gear. Also, other mechanical equivalents of such drives for transmitting rotary movement of the shaft end to arm 92 to control steering in response to polarity changes will occur to those skilled in the art.

In the game illustrated in FIG. 1 when vehicle 24 is in the outside lane and power is supplied to rotate shaft 50 such that arm 92 is driven to put the steering wheels in their left hand steering position, the toy vehicle will be caused to move from the outer lane to the inner lane, as is shown in FIG. 1 occurring with the vehicle 24. When this occurs the front end of the vehicle will engage the inner wall 16 of the track and the continuance of the steering wheels in this steering position will cause the vehicle to move along wall 16 in the inner lane 20 of the track. Of course, if the vehicle is moving at a relatively high rate of speed as it goes about a curve in the track it may be propelled by centrifugal force into the outer lane. However, if the left hand steering position of the wheels is maintained, it will move inwardly again in the inner lane as previously described.

On the other hand, when the polarity of current supplied to the motor 48 is reversed drive element 98 will rotate in an opposite direction, driving arm 92 to its other extreme position and placing the steering wheels in their right hand steering position, causing the vehicle to move to the right. Thus, as illustrated in FIG. 1 by the vehicle 24 shown in dotted lines, when the vehicle is in the inner lane 20 of track 12 and the polarity of the current flow to the motor 48 is changed so that the steering wheels are placed in their right hand steering position the vehicle will move towards its right into outer lane 22. When the front end of the vehicle hits outer wall 14 it will continue to move along that outer wall in outer lane 22 until the polarity of current supplied to the motor 48 is again reversed. In this regard it is again noted that because of the drive transmission arrangement the vehicle will always be propelled in a forward direction regardless of the direction of rotation of the output element 42 of the motor.

In order to supply current to the toy vehicles the track surface 18 is provided with a plurality of electrical contact strips in each of the lanes 20, 22. In the illustrative embodiment of the invention each lane is provided with three contact strips A, B and C respectively. The stips are formed of an electrically conductive metallic material and are embedded in the track so that they are substantially flush with the surface of the track and present no obstacle to movement of the vehicles from one lane to the other. Current is supplied to these strips, as described hereinafter, and is collected by current collectors mounted on the frame 32 of the toy vehicles in predetermined locations.

The contact strips in each lane are paired with each other, i.e., the A strip in one lane is electrically connected to the A strip in the other lane, the B strips are connected to each other and the C strips are connected to each other. The C strips are connected to electrical ground and the A and B strips are provided to separately supply current and control polarity of the current to the respective vehicles so that two vehicles can operate in the same lane and still be separately controlled. For this reason the current collector and the vehicles are arranged to associate the respective vehicles with only one of the pairs of contact strips. For example, vehicle 24 will obtain current from strips B, while vehicle 26 will obtain current only from strips A.

Figure 6:
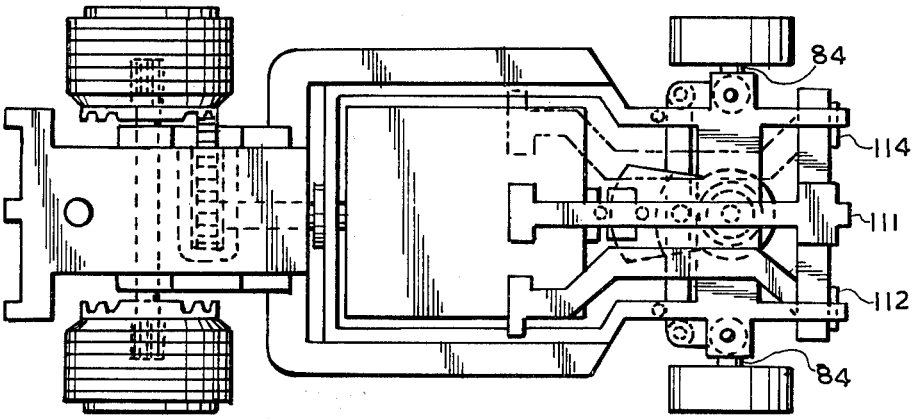
FIG. 6 is a bottom view of the toy vehicle of FIG. 2.

As illustrated in FIG. 6 vehicle 24 is provided with two current collectors 111, 112 with the current collector 112 thereof positioned to contact ground strip C. Similarly vehicle 26 has current collectors 112, 114 mounted thereon with current collector 112 located in the same position as the corresponding collector of vehicle 24 for also contacting the ground strip C. These current collectors are mounted on the vehicle in any convenient manner known in the art, and are electrically connected in a known manner to motor 48 of their respective vehicles. Current collector 111 of vehicle 24 is mounted on the vehicle to engage contact strips B regardless of which lane the vehicle is in. As seen in FIG. 6 this current collector is located centrally of the vehicle frame. On the other hand (as shown in dotted lines in FIG. 6) the current collector 114 of vehicle 26 would be located off center from the center line of the vehicle body and in spaced relation to its associated current collector 112. This current collector is positioned to engage contact strips A regardless of the lane in which the vehicle is moving. Vehicle 26 of course would not have a central current collector 111. By this arrangement, each of the operators can separately control current supply and polarity to contact strips A, B to control a respective one of the vehicles 24, 26 regardless of the lane occupied by the vehicle.

Figure 7:
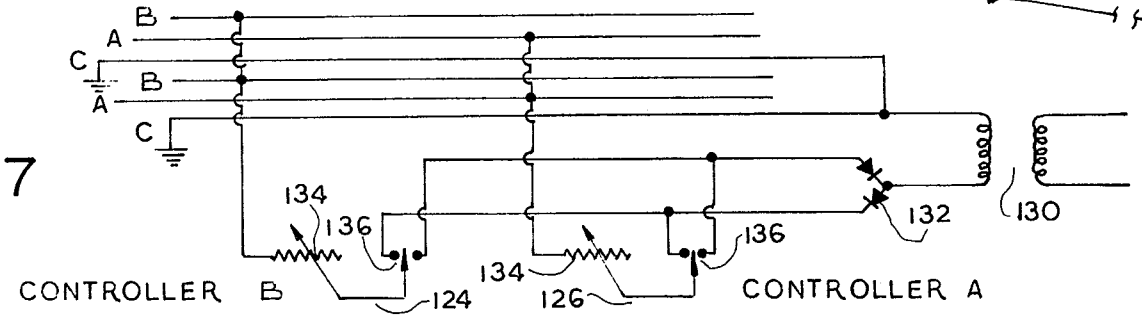
FIG. 7 is a schematic electrical circuit diagram of the electrical control system used for the toy vehicle game of FIG. 1.
Figure 2:
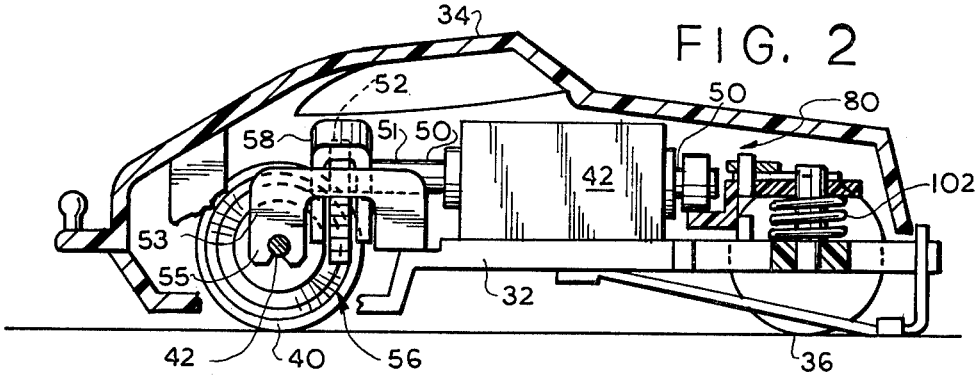
FIG. 2 is a longitudinal sectional view of the toy vehicle adapted for use with the game of FIG. 1.

The control system 30 for the toy vehicle game illustrated in FIG. 1, is shown schematically in FIG. 7. This control system includes respective controllers 124, 126 by which the players can control the vehicles 24, 26 respectively. Essentially the control system includes a plug 128 by which the system can be connected to an electrical AC power source, and it includes a transformer 130. Power is supplied from the transformer 130 through a halfwave rectifier 132 including two diodes connected as shown to separately supply current to the controllers 124, 126. Each controller is provided as a hand held unit and includes a variable resistor 134, operated as a trigger on the unit, as well as a single pole double throw switch 136. Current from controller 124 is supplied through its variable resistor 134 to the contact strips B and current from the controller 126 is supplied through its variable resistor to the contact strips A. The variable resistors may be of any convenient construction to permit the operators to vary the current supplied to their respective contact strips, and thus their respective vehicles, in order to vary the speed of the vehicles.

The polarity of the current supplied to the toy vehicles is separately and independently controlled by switches 136 so that the polarity of current supplied to motor 48 of the respective vehicles, as controlled by the respective controllers, will vary in accordance with the position in which the switches 136 are placed. By this arrangement each player, using his controller 126 or 124, can control the speed of his vehicle along the track 12 and he can also variably position his vehicle along the track simply by changing the polarity of current supplied to the vehicle. As described above the polarity of the current supplied to the motor of the respective toy vehicles will determine which of the two steering positions the wheels will occupy, and this will determine which lane the vehicle will be driven to and in.

As illustrated in FIG. 1, when it is desired to switch a vehicle from the outer lane to the inner lane, as shown with vehicle 24, the polarity of current supplied to the vehicle is selected to move the steering wheels to their left hand steering position, thereby moving the vehicle leftwardly into the inner lane. Likewise, when it is desired to move the vehicle outwardly the steering wheels are changed to their right hand steering position, by properly selecting the polarity of current supplied to the motor of the vehicle, so that the vehicle will move toward the right and into the outer lane. Thus the operators have complete control over both the speed of the vehicle and the lane in which the vehicle will move.

Accordingly, it is seen that a relatively simply constructed toy vehicle game is provided in which players have complete independent control over the speed of operation of the toy vehicles, including the ability to cause the toy vehicles to shift independently from one lane to the other in order to pass each other. This is achieved without the complexities of multiple element steering systems or solenoid bumper and steering arrangements. Moreover, it is accomplished with a simple change in polarity of the current flow to the toy vehicle's motor and eliminates the attendant loss of speed which occurs with previously proposed structures wherein lane changes are provided as a result of shutting off of power to the vehicle motor.

Although illustrative embodiments of the present invention have been described herein with reference to the accompanying drawings, it is to be understood that the invention is not limited to that precise embodiment, but that various changes and modifications may be effected therein by one skilled in the art without departing from the scope or spirit of this invention.

What is claimed is:

1. A toy vehicle comprising a vehicle frame, a pair of drive wheels and at least one steering wheel mounted on said frame, said steering wheel being mounted for pivotal steering movement thereon; a reversible rotary drive motor mounted in said frame and having a rotary output; steering means operatively engaged with said rotary output of the motor for steering said drive wheel to the right or left depending upon the direction of rotation of said output including a steering arm operatively connected to said steering wheel to pivot the steering wheel in the right or left direction and steering transmission means operatively connected between said rotary output and said steering arm for converting rotation of said rotary output into left or right hand swinging movement of the arm in response to a change in the direction of rotation of said output; and drive transmission means in said frame drivingly engaged with said rotary output for driving said drive wheels in a forward direction regardless of the direction of rotation of said rotary output; said drive transmission means including at least one transmission element movably mounted in said frame for movement between first and second positions in response to the direction of rotation of the drive motor; said movably mounted transmission element including a gear support frame rotatably mounted for pivotal movement on an axis generally in alignment with the axis of rotation of said output and having at least one idler drive member rotatably mounted thereon and operatively engaged with said output, said idler drive member being associated with said drive wheels for respective operative engagement therewith in said first and second positions of the movably mounted transmission element to drive the vehicle in the forward direction regardless of the direction of rotation of the drive motor.

2. A toy vehicle as defined in claim 1 wherein said steering arm is pivotally mounted on said frame.

3. A toy vehicle as defined in claim 2 wherein said steering wheel includes a steering lever pivotally connected to said arm whereby pivotal movement of the arm is transmitted to said wheel.

4. A toy vehicle as defined in claim 3 wherein said steering transmission means includes a rotary power transmission element mounted on said motor output drivingly engaged with said arm to rotate the arm to the right or left in response to the direction of rotation of the motor output.

5. The toy vehicle as defined in claim 4 wherein said transmission element is a friction wheel frictionally engaged with said arm.

6. A toy vehicle comprising a vehicle frame, a pair of steering wheels pivotally mounted on said frame for simultaneous steering movement between right and left hand steering positions with respect to the frame; a pair of drive wheels rotatably mounted on the frame; a reversible rotary drive motor on said frame having a rotary output element; first transmission means drivingly engaged with said output element and said drive wheels for driving said drive wheels in the forward direction of travel of the vehicle regardless of the direction of rotation of said output element; a steering arm rotatably mounted on said frame for pivotal movement therein between first and second positions and operatively connected to said steering wheels for transmitting such pivotal movement thereto, and second transmission means operatively engaged between said motor output element and said arm for oscillating said arm between said first and second positions in response to a change in the direction of rotation of said motor output element, thereby to change the steering direction of said steering wheels; said first transmission means including at least one transmission element movably mounted in the frame for movement between first and second positions in response to the direction of rotation of the drive motor to respectively drivingly engage one or the other of said drive wheels; said movably mounted transmission element including a gear support frame rotatably mounted in said vehicle for rotation in a plane generally perpendicular to the plane of rotation of the drive wheels and having at least one idler gear rotatably mounted thereon and drivingly engaged with said output elements; said idler gear being located on said support frame for selective operative engagement with one or the other of said drive wheels in said first and second positions of the movably mounted transmission element.

7. A toy vehicle as defined in claim 6 wherein said second transmission means includes a rotary power transmission element mounted on said motor output drivingly engaged with said arm to rotate the arm to the right or left in response to the direction of rotation of the motor output.

8. The toy vehicle as defined in claim 7 wherein said transmission element is a friction wheel frictionally engaged with said arm.

* * * * *